US005566785A

United States Patent [19]

Hakala

[11] Patent Number: 5,566,785

[45] Date of Patent: Oct. 22, 1996

[54] ELEVATOR DRIVE MACHINE PLACED IN THE COUNTERWEIGHT

[75] Inventor: Harri Hakala, Hyvinkää , Finland

[73] Assignee: Kone Oy, Helsinki, Finland

[21] Appl. No.: 266,697

[22] Filed: Jun. 28, 1994

[30] Foreign Application Priority Data

Jun. 28, 1993 [FI] Finland ..... 932972

[51] Int. Cl.[6] ..... B66B 9/02

[52] U.S. Cl. ..... 187/250; 187/404; 310/268

[58] Field of Search ..... 187/251, 266, 187/404, 373, 250; 310/67 A, 268

[56] References Cited

U.S. PATENT DOCUMENTS

| | | | |
|---|---|---|---|
| 3,101,130 | 8/1963 | Bianca | 187/94 |
| 4,771,197 | 9/1988 | Ivanto et al. . | |
| 4,960,186 | 10/1990 | Honda . | |
| 5,018,603 | 5/1991 | Ito . | |
| 5,062,501 | 11/1991 | Pavoz et al. . | |
| 5,086,881 | 2/1992 | Gagnon et al. | 187/251 |

FOREIGN PATENT DOCUMENTS

| | | | |
|---|---|---|---|
| 0630849 | 12/1994 | European Pat. Off. . | |
| 930101 | 7/1993 | Finland . | |
| 52-32870 | 8/1975 | Japan . | |
| 962322 | 7/1964 | United Kingdom | 310/268 |

*Primary Examiner*—H. Grant Skaggs
*Assistant Examiner*—T. Kelly
*Attorney, Agent, or Firm*—Birch, Stewart, Kolasch & Birch LLP

[57] ABSTRACT

An elevator suspended by ropes is provided with a rotating elevator motor placed in a counterweight of the elevator. The motor has a traction sheave. A gear system is not necessarily needed, because the structure and placement of the motor allow the use of a motor having a large diameter and a high torque. Because the length of the motor remains small, the motor and counterweight can be accommodated in a space normally reserved for a counterweight in the elevator shaft. The motor shaft lies in the counterweight substantially midway between the guide rails. The number of ropes is equal on both sides of a plane going through a center of the guide rails.

20 Claims, 2 Drawing Sheets

ELEVATOR DRIVE MACHINE PLACED IN THE COUNTERWEIGHT

FIELD OF THE INVENTION

The present invention relates to the counterweight of a rope-suspended elevator moving along guide rails and to an elevator drive machinery/motor placed in the counterweight, said motor comprising a traction sheave, a bearing, an element supporting the bearing, a shaft, a stator provided with a winding, and a rotating rotor.

DESCRIPTION OF THE BACKGROUND ART

Traditionally, an elevator machinery consists of a hoisting motor which, via a gear, drives the traction sheaves around which the hoisting ropes of the elevator are passed. The hoisting motor, elevator gear and traction sheaves are generally placed in a machine room above the elevator shaft. They can also be placed beside or below the elevator shaft. Another known solution is to place the elevator machinery in the counterweight of the elevator. The use of a linear motor as the hoisting machine of an elevator and its placement in the counterweight are also known.

Conventional elevator motors, e.g. cage induction, slip ring or d.c. motors, have the advantage that they are simple and that their characteristics and the associated technology have been developed during several decades and have reached a reliable level. In addition, they are advantageous with in respect to price. A system with a traditional elevator machinery placed in the counterweight is presented e.g. in publication U.S. Pat. No. 3,101,130. A drawback with the placement of the elevator motor in this solution is that it requires a large cross-sectional area of the elevator shaft.

Using a linear motor as the hoisting motor of an elevator involves problems beacause either the primary part or the secondary part of the motor has to be as long as the shaft. Therefore, linear motors are expensive to use as elevator motors. A linear motor for an elevator, placed in the counterweight, is presented e.g. in publication U.S. Pat. No. 5,062,501. However, a linear motor placed in the counterweight has certain advantages, e.g. that no machine room is needed and that the motor requires but a relatively small cross-sectional area of the counterweight.

The motor of an elevator may also be of the external-rotor type, in which the traction sheave is joined directly to the rotor. Such a structure is presented e.g. in publication JP 5232870. The motor is gearless. The problem with this structure is that, to achieve a sufficient torque, the length and diameter of the motor have to be increased. In the structure presented in U.S. Pat. No. 4,771,197, the length of the motor is further increased by the brake, which is placed alongside of the rope grooves. Moreover, the blocks supporting the motor shaft increase the motor length still further. If a motor according to U.S. Pat. No. 471197 is placed in the counterweight, the counterweight must have larger dimensions and cannot be accommodated in the space normally reserved for a counterweight.

Another previously known elevator machine is one in which the rotor is inside the stator and the traction sheave is attached to a disc placed at the end of the shaft, forming a cup-like structure around the stator. Such a solution is presented in FIG. 4 in publication U.S. Pat. No. 5,018,603. FIG. 8 in the same publication presents an elevator motor in which the air gap is oriented in a direction perpendicular to the motor shaft. Such a motor is called a disc motor or a disc rotor motor. These motors are gearless, which means that the motor is required to have a higher torque than a geared motor. The required higher torque again increases the diameter of the motor.

SUMMARY OF THE INVENTION

The object of the present invention is to produce a new structural solution for the placement of a rotating motor in the counterweight of an elevator, designed to eliminate the above-mentioned drawbacks of elevator motors constructed according to previously known technology.

The advantages of the invention include the following:

Placing the elevator motor in the counterweight as provided by the invention allows the use of a larger motor diameter without involving any drawbacks.

A further advantage is that the motor can be designed for operation at a low speed of rotation, thus rendering it less noisy. Having a high torque, the motor does not necessarily require a gear, although this could also be built inside the motor.

As compared with a linear motor, the motor of the invention provides the advantage that it makes it unnecessary to build an elevator machine room and a rotor or stator extending over the whole length of the elevator shaft.

The present invention also solves the space requirement problem which results from the increased motor diameter and which restricts the use of a motor according to publication U.S. Pat. No. 4,771,197. Likewise, the length of the motor, i.e. the thickness of the counterweight is substantially smaller in the motor/counterweight of the invention than in a motor according to U.S. Pat. No. 4,771,197.

A further advantage is that the invention involves a saving in counterweight material corresponding to the weight of the motor.

The motor/counterweight of the invention has a very small thickness dimension (in the direction of the motor shaft), so the cross-sectional area of the motor/counterweight of the invention in the cross-section of the elevator shaft is also small and the motor/counterweight can thus be easily accommodated in the space normally reserved for a counterweight.

According to the invention, the placement of the motor in the counterweight is symmetrical in relation to the elevator guide rails, which is an advantage regarding the guide rail strength required.

The motor may be a cage induction, reluctance or asynchronous motor.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail in the light of an embodiment by referring to the drawings which are given by way of illustration only, and thus are not limitative of the present invention, and, in which.

DETAILED DESCRIPTION OF THE PREFERRED EMBODIMENTS

Figure 1:
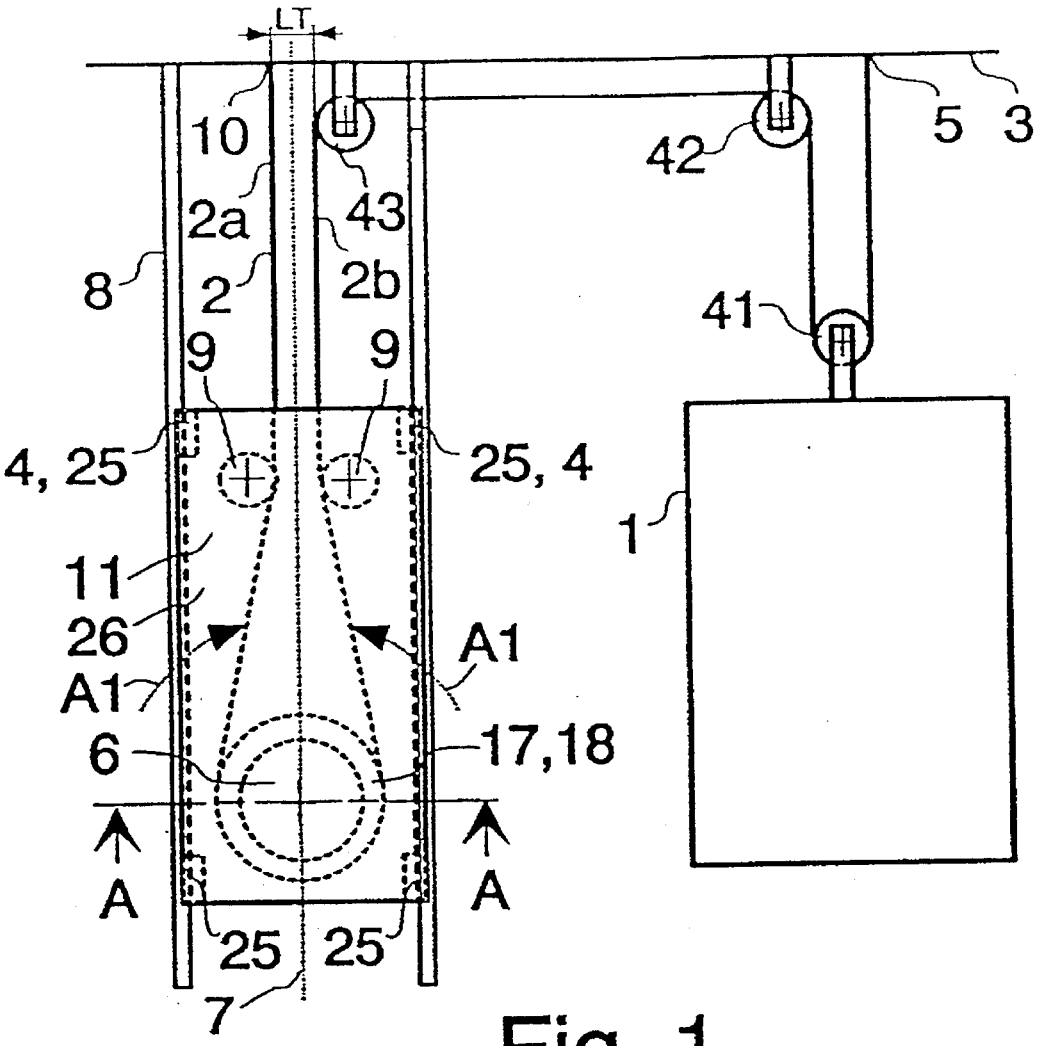
FIG. 1 shows a diagrammatic illustration of an elevator motor according to the invention, placed in the counterweight and connected to the elevator car by means of ropes.

In FIG. 1, the elevator car 1, suspended on the ropes 2, moves in the elevator shaft in a substantially vertical direction. One end of each rope is anchored at point 5 at the top part 3 of the shaft, from where the ropes are passed over a diverting pulley 41 on the elevator car 1 and diverting pulleys 42 and 43 at the top part 3 of the shaft to the traction sheave 18 of the elevator motor 6 in the counterweight 26 and further back to the shaft top, where the other end of each rope is anchored at point 10. The counterweight 26 and the elevator motor 6 are integrated in a single assembly. The motor is placed substantially inside the counterweight, and the motor/counterweight moves vertically between the guide rails 8, which receive the forces generated by the motor torque. The counterweight 26 is provided with safety gears 4 which stop the motion of the counterweight in relation to the guide rails 8 when activated by an overspeed of the counterweight or in response to a separate control. The space LT required by the rope sets in the horizontal direction of the shaft is determined by the diverting pulleys 9 on the counterweight, the point 10 of rope anchorage and the position of diverting pulley 43 at the shaft top 3. By suitably placing the diverting pulleys 9 in relation to the traction sheave 18, the gripping angle A1 of the ropes around the traction sheave is set to a desired magnitude. In addition, the diverting pulleys 9 guide the rope sets going in opposite directions so that they run at equal distances from the guide rails 8. The center line between the diverting pulleys 9 and that of the motor shaft lie substantially on the same straight line 7. The diverting pulleys 9 increase the frictional force between the rope 2 and the traction sheave 18 by increasing the angle of contact A1 of the rope around the traction sheave, which is another advantage of the invention. FIG. 1 does not show the elevator guide rails and the supply of power to the electric equipment because these are outside the sphere of the invention.

The motor/counterweight of the invention can have a very flat construction. The width of the counterweight can be normal, i.e. somewhat narrower than the width of the elevator car. For an elevator designed for loads of about 800 kg, the diameter of the rotor of the motor of the invention is approx. 800 mm and the total counterweight thickness may be less than 160 mm. Thus, thanks to the flat motor construction, the counterweight of the invention can easily be accommodated in the space normally reserved for a counterweight. The large diameter of the motor provides the advantage that a gear is not necessarily needed. Placing the motor in the counterweight as provided by the invention allows the use of a larger motor diameter without involving any drawbacks. Although the motor has a larger diameter than a conventional motor, it can be easily fitted between the guide rails.

Figure 2:
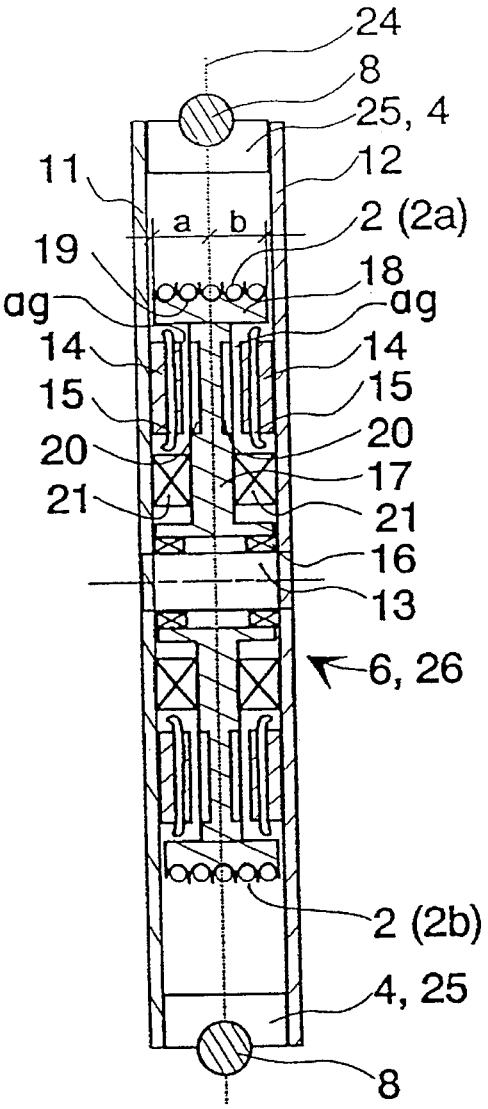
FIG. 2 shows a cross-section of an elevator motor placed in the counterweight according to an embodiment of the invention.

FIG. 2 presents section A—A of FIG. 1, showing the elevator motor 6. The motor 6 has a disc-shaped rotor 17 placed in the middle, so the motor has two air gaps ag to allow a higher torque. In this way, a symmetrical motor structure is achieved which is advantageous in respect of its strength properties, because the torsion applied to the traction sheave by the ropes is now transmitted to the motor shaft via a shorter lever arm. The motor 6 is placed at least partially inside the counterweight, and the motor is integrated with the counterweight 26 of the elevator by using at least one part of the motor, in this case an end shield, as a stator supporting element 11 which simultaneously forms a part of the counterweight, a side plate. Thus, the side plate 11 forms a frame part transmitting the load of the motor and counterweight. The structure comprises two side plates 11 and 12, with a shaft 13 between them. Attached to the side plate 11 is also the stator 14, with a stator winding 15 on it. Alternatively, the side plate 11 and the stator can be integrated in a single structure. Mounted on the shaft 13 by means of a bearing 16 is a disc-shaped rotor 17, which is substantially centrally placed in relation to the counterweight. The traction sheave 18 on the outer surface of the rotor 17 is provided with five rope grooves 19. The number of ropes may vary as required, but this embodiment has five ropes, each one of which makes an almost complete wind around the traction sheave. The traction sheave 18 can be a separate cylindrical body around the rotor 17, or the traction sheave and the rope grooves can be integrated with the rotor in a single body. The traction sheave is centrally placed in relation to the guide rails so that one half of the rope sets 2*a* and 2*b* running in the same direction lies on one side of the plane 24 passing via the center lines of the guide rails while the other half lies on the other side of said plane (a=b). The rotor is provided with rotor windings 20, one on each side of the rotor disc (when a reluctance or synchronous motor is used, the rotor is naturally constructed according to the requirements of those motor types). There are two air gaps ag between the rotor 17 and stator 14. The shaft 13 is fixed to the stator, but it could alternatively be fixed to the rotor, in which case the bearing would be placed between the rotor 17 and side plate 11 or both side plates 11 and 12. Attached to the side plates of the counterweight are guides 25 designed to guide the counterweight movement between the guide rails 8. The guides also serve to transmit the supporting forces resulting from the operation of the motor to the guide rails. Side plate 12 acts as an additional reinforcement and stiffener for the counterweight/motor structure, because the horizontal shaft 13, the guides 25 and the diverting pulleys 9 guiding the ropes are attached to opposite points on the two side plates. Alternatively, auxiliary flanges could be used to attach the shaft 13 to the side plates, but this is not necessary for the description of the invention. Similarly, the stator core packets of stampings could be fastened to ring-like parts of the side plates 11 and 12 and these parts could then be fixed with bolts to appropriate points in the side plates. The motor placed in the counterweight is also provided with a brake 21. The brake is placed between the rotor 17 and the side plates 11 and 12. The rotor disc surface under the brake 21 can be provided with a separate braking surface.

Figure 3:
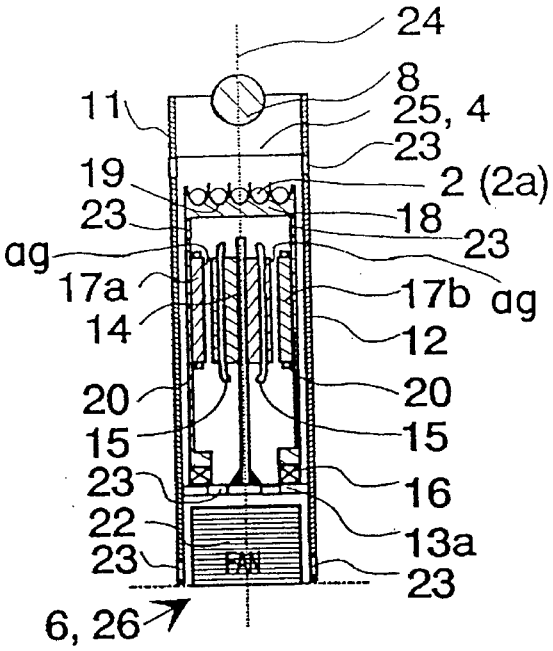
FIG. 3 presents a cross-section of an elevator motor placed in the counterweight according to another embodiment of the invention.

FIG. 3 presents a motor placed at least partially inside the counterweight which is otherwise identical with the one in FIG. 2 except that the stator 14 and its core of stampings and winding 15 is now built in a disc placed substantially in the middle of the motor 6 in the direction of its shaft 16. The figure shows only one half of the motor as seen in section A—A of FIG. 1. The rotor 17 and its windings 20 are divided into two discs 17*a* and 17*b* placed on either side of the stator 14. The motor has two air gaps ag, as was the case in the motor of FIG. 2. The motor 6 is provided with a cooling fan 22 built inside the shaft 16. The fan receives air through holes 23 in the side plates 11 and 12 and blows it through the motor and further out through holes provided in the rotor discs 17*a* and 17*b*. This arrangement also provides the advantage that the traction sheave 18 and therefore the elevator ropes 2 in its grooves 19 are effectively cooled by the air flow at the same time. The common part integrated with the motor 6 and counterweight 26 is the motor shaft 13*a*, which is a structure connecting and bracing the side plates 11 and 12 of the counterweight. The side plates 11 and 12 could as well be called end shields of the motor, although they are in a way outside the motor.

It is obvious to a person skilled in the art that different embodiments of the invention are not restricted to the example described above, but that they may instead be varied within the scope of the claims presented below. It is therefore obvious to the skilled person that it is inessential to the invention whether the counterweight is regarded as being integrated with the elevator motor or the elevator motor with the counterweight, because the outcome is the same and only the designations might be changed. It makes no difference to the invention if e.g. the side plates of the counterweight are designated as parts of the motor or as parts of the counterweight.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. Counterweight of a rope-suspended elevator movable along guide rails and an elevator motor placed in the counterweight, a guide rail plane passes through centers of at least two of the guide rails and said motor comprising:

a traction sheave, a bearing, a shaft, an element supporting the bearing, a stator provided with a plurality of windings and at least one rotating disc-shaped rotor, air gaps being provided in the motor between the at least one rotor and the stator windings, planes formed by the air gaps being substantially perpendicular to the shaft of the motor, the traction sheave being directly attached to the at least one rotor and intersecting the guide rail plane.

2. The elevator motor according to claim 1, wherein the traction sheave receives at least one rope from the elevator which is at least partially wound around the traction sheave and wherein the guide rail plane passes through a center of the elevator motor.

3. The elevator motor according to claim 1, wherein the traction sheave receives at least one rope from the elevator which is at least partially wound around the traction sheave and wherein the guide rail plane passes generally through a center of the traction sheave.

4. The elevator motor according to claim 1, wherein a central plane of the elevator motor passes through a center of the elevator motor and is generally parallel to the planes formed by the air gaps and wherein a plane passing through a center of the traction sheave coincides with the central plane of the elevator motor.

5. The elevator motor according to claim 1, wherein a central plane of the elevator motor passes through a center of the elevator motor and is generally parallel to the planes formed by the air gaps and wherein a plane passing through a center of the at least one rotor coincides with the central plane of the elevator motor.

6. The elevator motor according to claim 1, wherein two stators are provided, each of the stators having at least one winding and each stator being generally a same thickness.

7. The elevator motor according to claim 1, wherein the at least one rotor comprises two disc-shaped rotors and wherein the stator is mounted between the two rotors.

8. The elevator motor according to claim 7, wherein the traction sheave is mounted between the two rotors.

9. The elevator motor according to claim 1, wherein the elevator motor is placed at least partially inside the counterweight.

10. The elevator motor according to claim 1, wherein the shaft of the elevator motor lies substantially on a center line between the guide rails of the counterweight.

11. The elevator motor according to claim 1, wherein at least a part of the elevator motor is a common part with the counterweight.

12. The elevator motor according to claim 11, wherein the common part is the element supporting the stator of the elevator motor, the element constituting a side plate forming a frame of the counterweight.

13. The elevator motor according to claim 12, wherein the stator is fixedly connected to the element supporting the stator and forming the side plate of the frame of the counterweight and wherein the at least one rotor is connected to said side plate by the bearing of the shaft.

14. The elevator motor according to claim 13, wherein the shaft is fixed to the at least one rotor and the bearing is between the shaft and the side plate.

15. The elevator motor according to claim 12, wherein the shaft is fixed to the side plate of the counterweight and the bearing is placed between the shaft and the at least one rotor.

16. The elevator motor according to claim 15, further comprising at least one diverting pulley mounted on the side plate of the counterweight, the at least one diverting pulley varying a contact angle of a rope running around the traction sheave.

17. The elevator motor according to claim 12, further comprising a brake for the elevator motor, the brake being placed between the side plate of the counterweight, the stator, the at least one rotor and the shaft.

18. The elevator motor according to claim 1, further comprising a plurality of diverting pulleys provided in the counterweight, the diverting pulleys varying a contact angle of a rope running around the traction sheave, the diverting pulleys being placed on the counterweight so that a midline between elevator ropes going in different directions lies generally midway between the elevator guide rails and the midline between elevator ropes going in a same direction lies in a plane passing through the guide rail plane.

19. The elevator motor according to claim 1, further comprising at least one guide on the counterweight for guiding the counterweight along the guide rails, the at least one guide being attached to the element supporting the stator of the elevator motor, the element also forming a frame of the counterweight.

20. The elevator motor according to claim 1, wherein two rotors are provided, the stator being located between the two rotors.

* * * * *